US009193417B2

(12) United States Patent
de Basto et al.

(10) Patent No.: US 9,193,417 B2
(45) **Date of Patent: *Nov. 24, 2015**

(54) WATER CRAFT HAVING OPEN UPPER DECK, AFT SWIM DECK AND COLLAPSIBLE BULWARKS

(71) Applicants: Luiz de Basto, Miami, FL (US); Enrique Ramirez Magaña, Morelia (MX)

(72) Inventors: Luiz de Basto, Miami, FL (US); Enrique Ramirez Magaña, Morelia (MX)

(73) Assignee: DAY YACHT DESIGN AND ENGINEERING, INC., Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/219,636

(22) Filed: Mar. 19, 2014

(65) Prior Publication Data

US 2014/0202372 A1 Jul. 24, 2014

Related U.S. Application Data

(63) Continuation of application No. 13/608,734, filed on Sep. 10, 2012, now Pat. No. 8,752,499.

(60) Provisional application No. 61/532,956, filed on Sep. 9, 2011.

(51) Int. Cl.

| | |
|---|---|
| ***B63B 7/04*** | (2006.01) |
| ***B63B 17/00*** | (2006.01) |
| ***B63B 3/48*** | (2006.01) |
| ***B63B 17/04*** | (2006.01) |
| ***B63B 29/02*** | (2006.01) |
| *B63B 35/73* | (2006.01) |
| *B63B 23/62* | (2006.01) |

(52) U.S. Cl.

CPC ... *B63B 7/04* (2013.01); *B63B 3/48* (2013.01); *B63B 17/00* (2013.01); *B63B 17/04* (2013.01); *B63B 29/02* (2013.01); *B63B 23/62* (2013.01); *B63B 35/73* (2013.01); *B63B 2003/485* (2013.01); *B63B 2017/045* (2013.01); *B63B 2029/022* (2013.01)

(58) Field of Classification Search

CPC ..... B63B 17/00; B63B 17/04; B63B 3/48; B63B 29/02; B63B 43/00; B63B 35/73

USPC ..... 114/362, 364

See application file for complete search history.

(56) References Cited

U.S. PATENT DOCUMENTS

| | | | | |
|---|---|---|---|---|
| 3,325,836 | A * | 6/1967 | Lankford, Jr. | 114/364 |
| 5,572,944 | A | 11/1996 | Slikkers et al. | |
| 5,915,328 | A * | 6/1999 | Rowan | 114/362 |
| 6,840,825 | B1 | 1/2005 | Messano | |
| 8,752,499 | B2 * | 6/2014 | De Basto et al. | 114/364 |
| 2002/0033127 | A1 | 3/2002 | Barrett | |
| 2007/0006789 | A1 * | 1/2007 | Davidson et al. | 114/362 |

* cited by examiner

FOREIGN PATENT DOCUMENTS

| | | |
|---|---|---|
| WO | WO 96/28339 A1 | 9/1996 |

*Primary Examiner* — Lars A Olson

(74) *Attorney, Agent, or Firm* — LOTT & FISCHER, PL

(57) ABSTRACT

Disclosed is water craft providing inventive features to achieve a double-decked vessel having: a) substantially continuous, flat and open upper deck; b.) a substantially continuous and flat lower deck with an enclosed fore section and an exposed aft section forming a swim deck; and c.) a system of collapsible bulwarks in the upper and swim decks that permit the vessel to transition from a traditional configuration (better suited for travel) to an open configuration (better suited for entertainment activities while stationary).

16 Claims, 11 Drawing Sheets

WATER CRAFT HAVING OPEN UPPER DECK, AFT SWIM DECK AND COLLAPSIBLE BULWARKS

CROSS-REFERENCE TO RELATED APPLICATIONS

This application is a continuation of U.S. patent application Ser. No. 13/608,734, filed 10 Sep. 2012, now U.S. Pat. No. 8,752,499, which claims the benefit of U.S. Provisional Patent Application Ser. No. 61/532,956 filed on 9 Sep. 2011, each of which is incorporated by reference in its entirety herein, and from which priority is claimed.

FIELD OF INVENTION

The invention relates generally to the features of a recreational water craft and in particular to a recreational water craft incorporating collapsible bulwarks, an open upper deck and a lower level swim deck with expandable surfaces.

SUMMARY OF INVENTION

It is among the objects of this invention to overcome the limitations of the heretofore-known water craft by providing inventive features to achieve a double-decked vessel having: a.) a substantially continuous, flat and open upper deck; b.) a substantially continuous and flat lower deck with an enclosed fore section and an exposed aft section forming a swim deck; and c.) a system of collapsible bulwarks in the upper and swim decks that permit the vessel to transition from a traditional configuration (better suited for travel) to an open configuration (better suit for entertainment activities while stationary).

Although the invention is illustrated and described herein as embodied in a small to medium size water craft, it is nevertheless not intended to be limited to only the details shown, since various modifications and structural changes may be made therein without departing from the spirit of the invention and within the scope and range of equivalents of the claims.

The construction of the invention, however, together with additional objects and advantages thereof will be best understood from the following description of the specific disclosed embodiments when read in connection with the accompanying drawings.

DETAILED DESCRIPTION OF THE INVENTION

Figure 1:
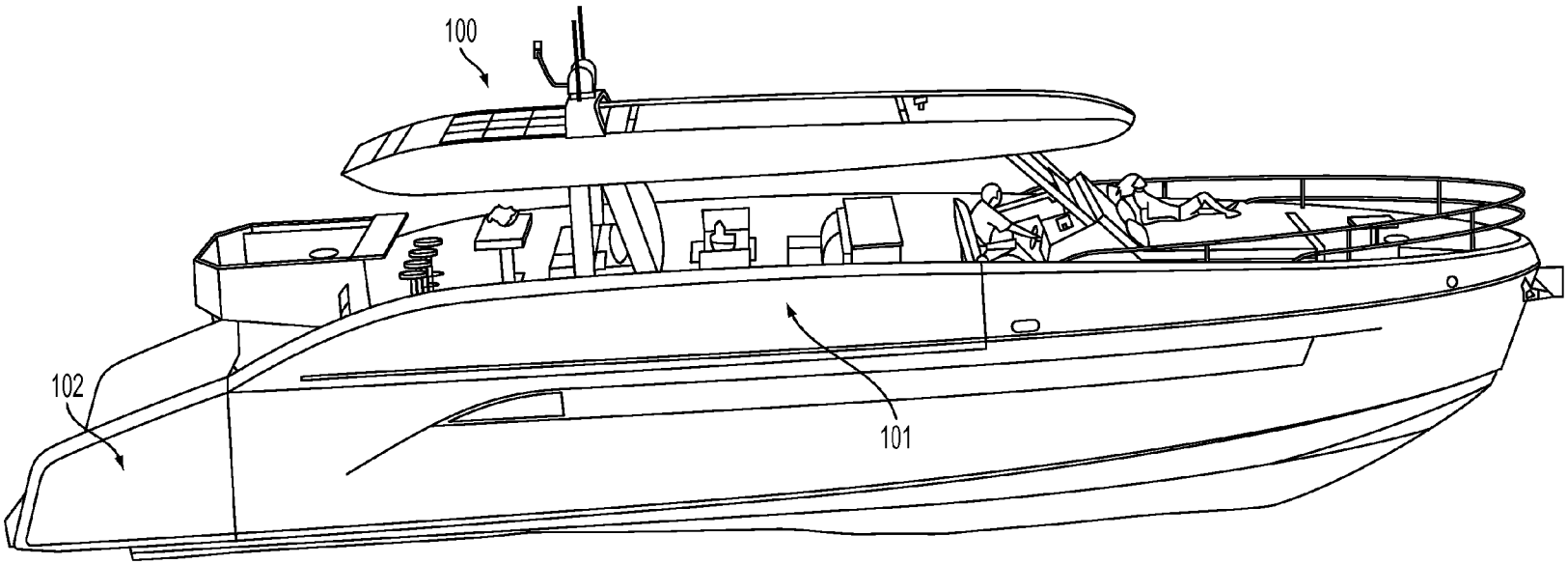
FIG. 1 is a rendering of an embodiment of the water craft of the present invention in its navigation configuration with the retractable bulwarks retracted.

Disclosed in the attached illustrations is a novel design for a pleasure marine craft. Among the novel aspects of the disclosed marine craft is a double-deck configuration comprising an upper exposed deck and a lower, substantially enclosed deck. The exposed upper deck comprises a completely open floor plan design consisting of a single level, substantially flat, deck in which the only permanent protuberance is a console housing the engine controls for the marine craft and, optionally, supports for a roof structure.

As a result of the open floor plan, a passenger on the disclosed pleasure craft will be able to completely ambulate every inch of the upper deck, from bow to stem, starboard to port, without requiring the climbing of steps or the avoidance of consoles, closets, walls, furniture, cabins or other obstructions typically found on pleasure marine craft.

Another novel aspect of the upper deck is the use of collapsible bulwarks on both sides of the deck. The collapsible bulwarks are hinged at the floor level, and collapse outwardly 90 degrees. When in the collapsed position, the bulwarks act as extensions of the deck floor providing a significantly expanded upper deck. The collapsed bulwarks thus become part of the deck and can be used to enhance the visual experience and the available space on the deck.

For safety purposes, the inside (when stowed) or top when extended) surfaces of the collapsible bulwarks are equipped with a storable and/or removable handrail system. When the bulwarks are in their collapsed position, the handrails are removed or stowed and lay hidden and substantially flush with the bulwark surfaces. Once the bulwarks are extended, the handrails can be reinstalled or deployed or remain stowed depending on the vessel's configuration and sea conditions.

When the vessel is in its navigation configuration with the bulwarks extended, the handrails are deployed to provide additional safety to occupants and to prevent from occupants or objects from accidentally falling overboard. Once the vessel is at anchor, and sea conditions are sufficiently calm, the handrails can be stowed or removed to provide a clear deck. The handrail system permits for removal of individual handrails so that some portions of the bulwarks remain guarded, while others can be cleared.

In addition, the handrail and bulwark system can optionally incorporate an alarm system to advise the vessel's operator that the handrails are in a position deemed unsafe for the anticipated conditions. For example, the alarm would sound if the vessel's engines are started with the bulwarks in the extended position or with the handrails stowed or removed.

The combination of the open floor plan and collapsible bulwarks create an amount of usable, unobstructed space that is usually found only in large vessels with a fly bridge (also referred to as a flight or flying bridge) without the drawbacks or expense of a much larger vessel.

The lower deck of the disclosed marine craft is comprised of fore and aft sections and is located slightly above the waterline. The fore section is enclosed and located directly below the upper deck. The aft portion is an exposed extension of the fore portion, forming the stern of the marine craft.

The floor of the lower deck is also substantially flat from bow to stern, with the aft portion serving as a "swim deck" for the vessel. Like the upper deck, the aft portion of the lower deck employs collapsible bulwarks which, when deployed, significantly expand the surface area of the swim deck.

The of and fore portions of the lower deck can optionally be divided by a door. In one embodiment, the door separating the aft and fore portions of the lower deck covers substantially the entire space between the upper and lower decks at the point of convergence between the fore and aft portions of the lower deck. Accordingly, when said door is opened, a large entrance to the enclosed portion of the lower deck is provided. The enclosed space between the upper and lower decks can be utilized as cabin space for the vessels' occupants or for equipment such as jet skis or similar personal water craft.

Because the upper and lower decks are substantially flat, the overhead clearance available to the enclosed portion of the lower deck is substantially higher that that available to the lower deck of similar dual deck marine vessels. This significant overhead clearance and large opening of the enclosed portion of the lower deck give the space the feeling and appearance of a large "garage" which can be used to house smaller recreational marine vessels, such as Jet Skis®, wave runners, dinghies, and the like.

The upper and lower decks are connected by one or more staircases or ladders that can optionally be located on either side of the lower deck's door or within the enclosed portion of the lower deck.

Figure 2:
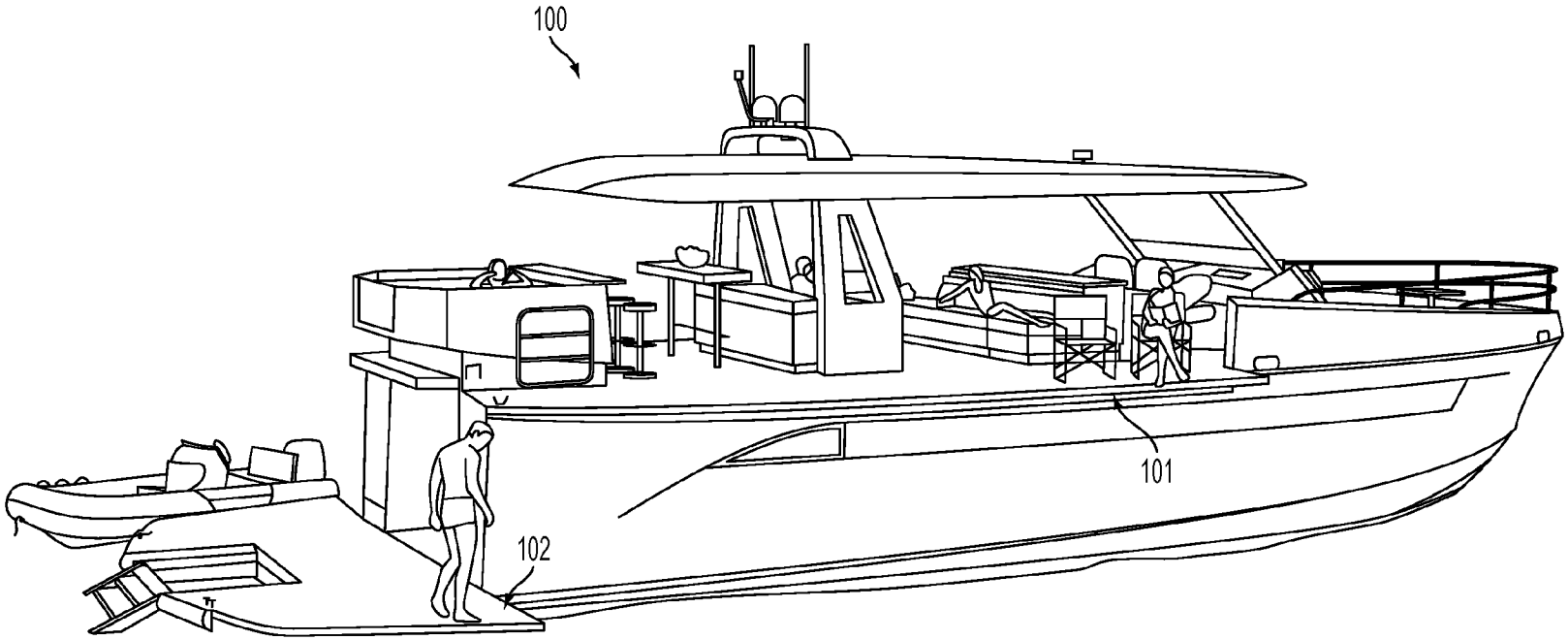
FIG. 2 is a rendering of an embodiment of the water craft of the present invention in its stopped configuration with the retractable bulwarks extended and no handrails.
Figure 3:
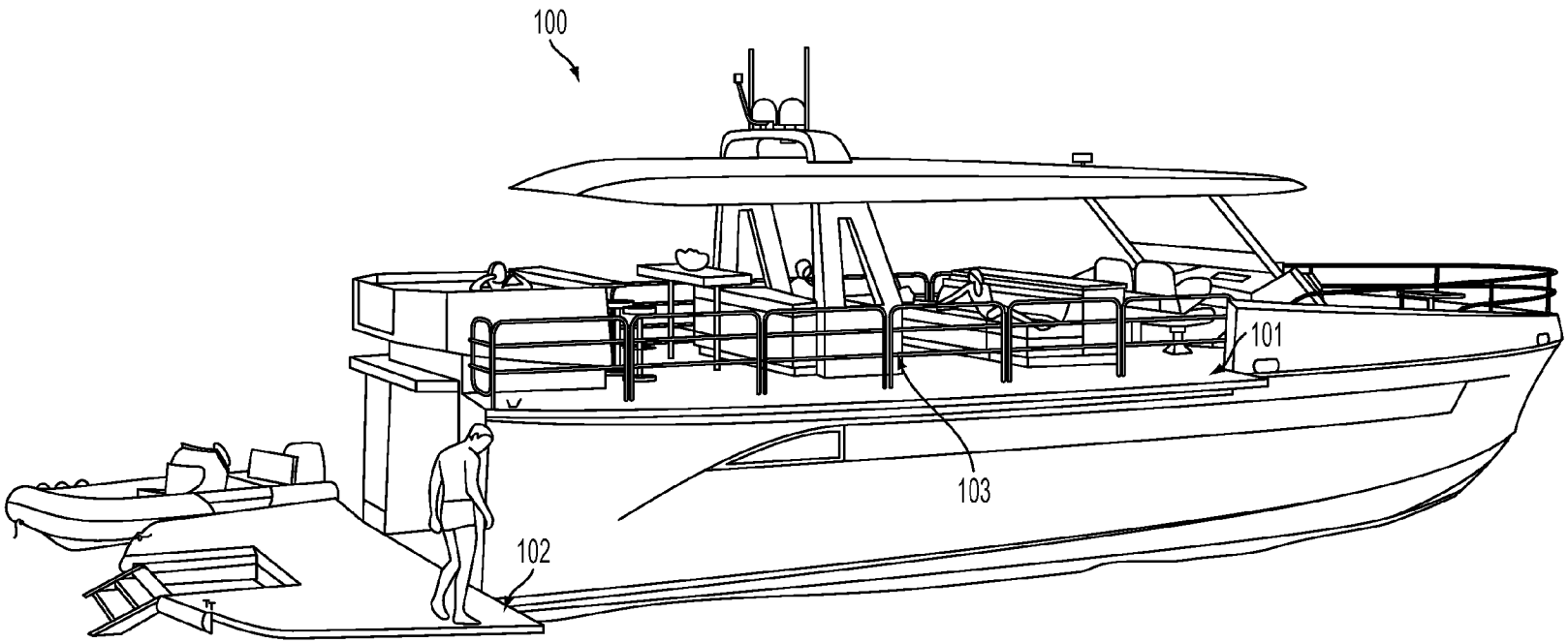
FIG. 3 is a rendering of an embodiment of the water craft of the present invention in its stopped configuration with the retractable bulwarks extended and handrails installed.

Referring now to FIGS. 1-3, shown are renderings of an embodiment of the disclosed marine vessel 100 in the navigation configuration with upper bulwarks 101 and lower bulwarks 102 retracted (FIG. 1), stopped configuration with upper bulwarks 101 and lower bulwarks 102 extended (FIG. 2) and stopped configuration with upper bulwarks 101 and lower bulwarks 102 extended and upper handrails 103 installed (FIG. 3)

Figure 4:
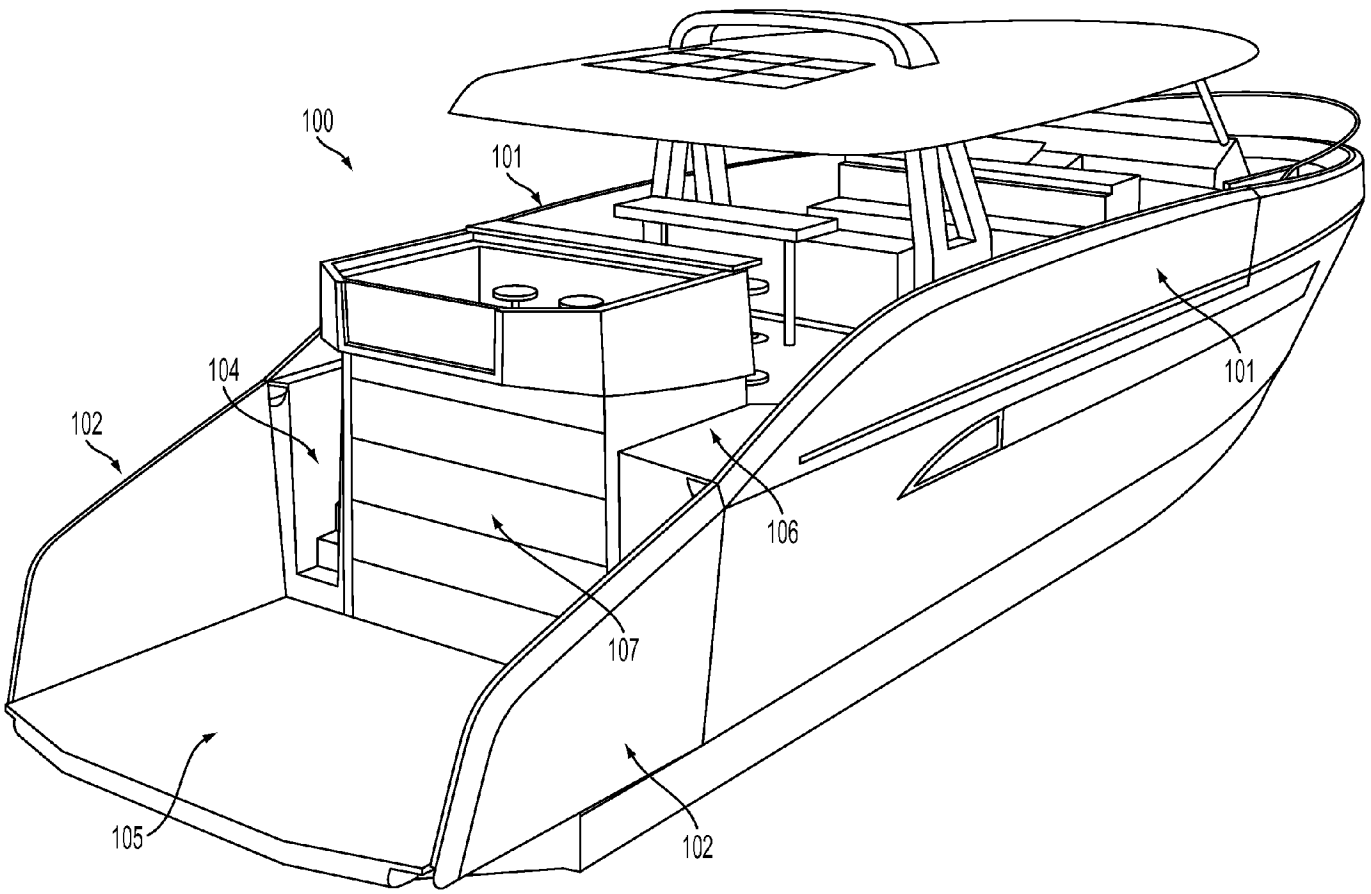
FIG. 4 is a rear-oriented view of an embodiment of the water craft of the present invention with the retractable bulwarks retracted.
Figure 5:
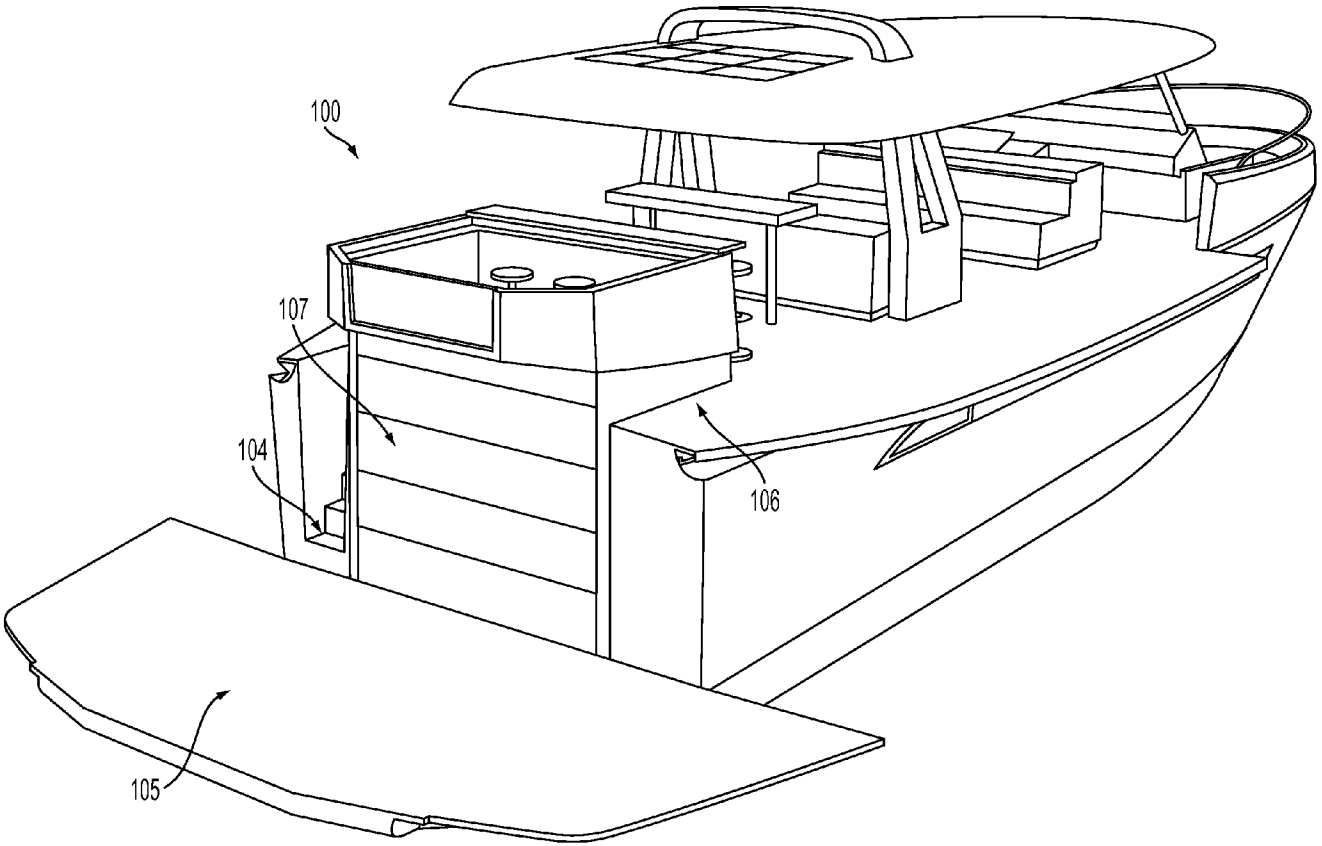
FIG. 5 is a rear-oriented view of an embodiment of the water craft of the present invention with the retractable bulwarks extended.

FIGS. 4-5 provide a rear-oriented view of the same embodiment as FIGS. 1-3 in which, again, the upper bulwarks 101 and lower bulwarks 102 are shown in retracted (FIG. 4) and extended (FIG. 5) configurations. Also visible from his view is staircase 104 leading from swim deck 105 to upper deck 106. Also clearly visible in this view is garage door 107 which, when opened, reveals the expansive interior "garage" of the lower deck.

Figure 6:
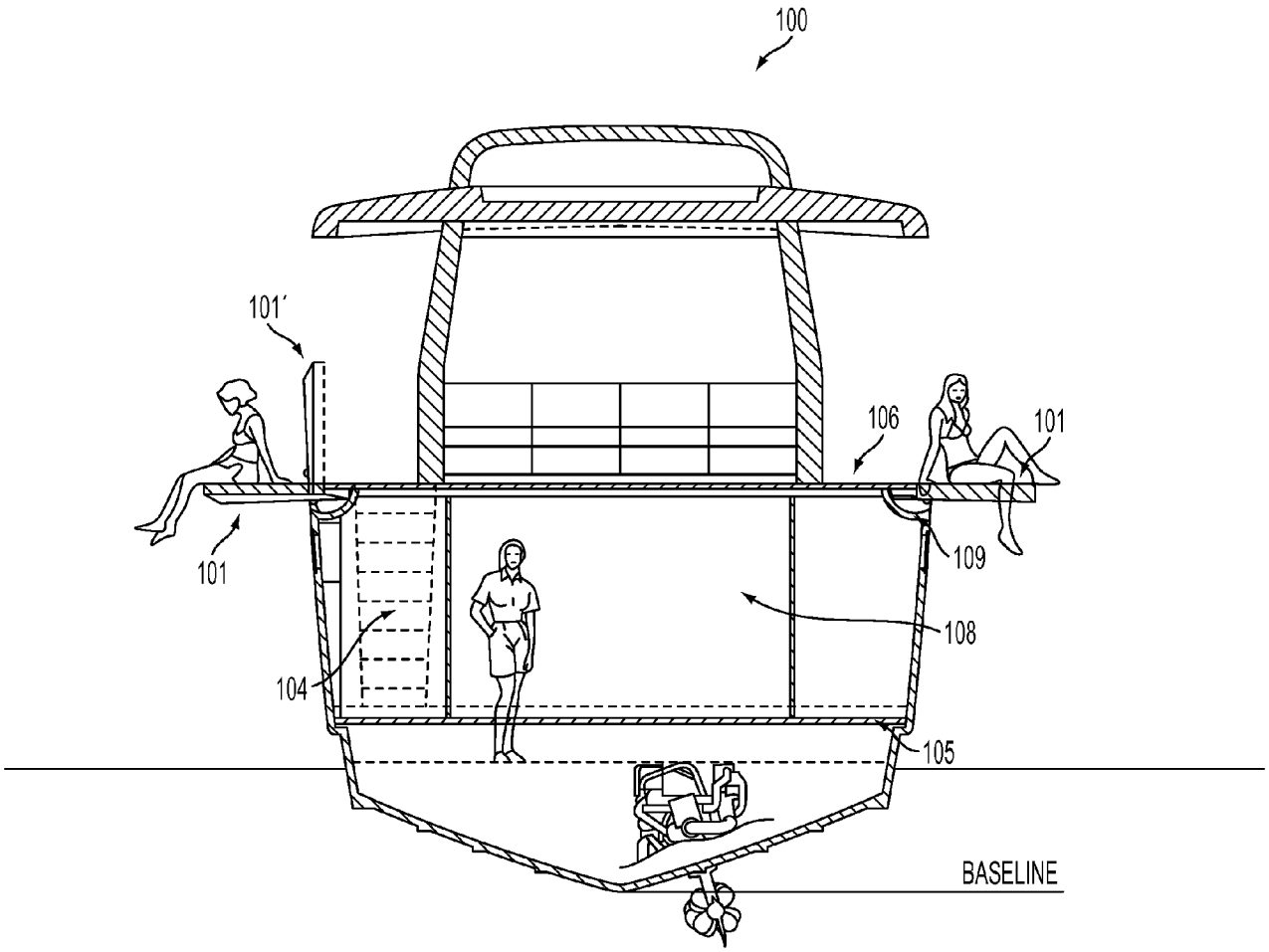
FIG. 6 is a rear elevation of an embodiment of the water craft of the present invention.

Shown in FIG. 6 is a rear elevation of the same embodiment of the present invention. For clarity, only the upper retractable bulwarks 101 are shown in the extended position. The upper retractable bulwarks are shown in the retracted position in phantom lines 101'. Also shown is staircase 104 which provides access from the swim deck 105 to the upper deck 106. Garage opening 108 is also shown in this view with the garage door (not visible) opened.

As shown in FIG. 6, upper retractable bulwarks 101 are joined with upper deck 106 by means of a continuous hinge 109 which extends through the entire length of the bulwark. The design of the hinge ensures that when the bulwarks 101 are in the extended position, there is no gap, discontinuity or level change between the upper deck 106 and bulwarks 101, thus forming a continuous expanded upper deck which is ideal for entertainment activities. A similar hinge configuration (not shown) is used for the joint between the lower retractable bulwarks 102 and swim deck 105.

Hinge 109 can be manually operated to extend bulwarks 101 and 102, or it may be equipped with an electric motor (not shown) to facilitate automated push-button deployment.

Figure 7:
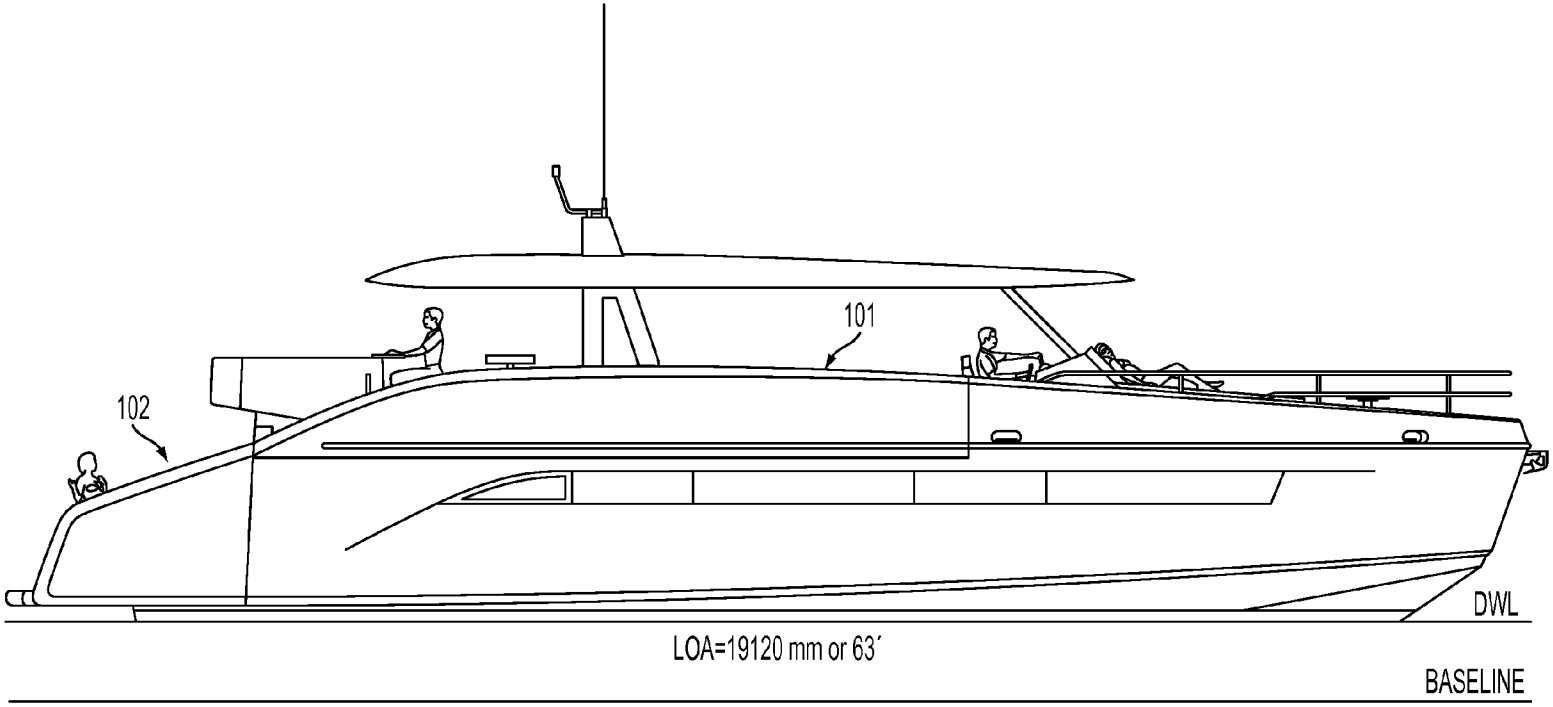
FIG. 7 is a side elevation of an embodiment of the water craft of the present invention with the retractable bulwarks retracted.
Figure 8:
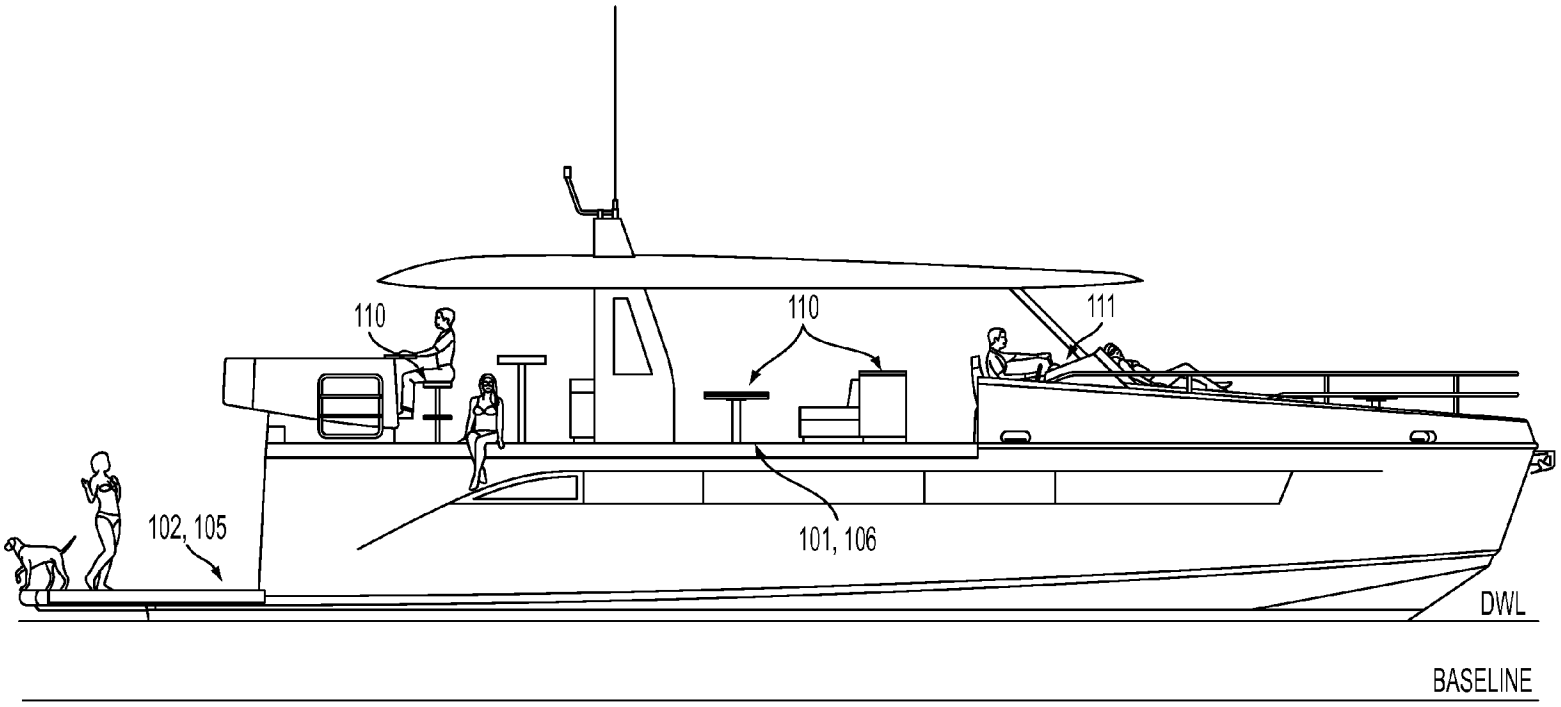
FIG. 8 is a side elevation of an embodiment of the water craft of the present invention with the retractable bulwarks extended.

Referring next to FIGS. 7-8, shown is a side elevation of the same embodiment of the present invention in which, again, the upper bulwarks 101 and lower bulwarks 102 are shown in retracted (FIG. 7) and extended (FIG. 8) configurations. In FIG. 8, also shown is optional, removable, deck furniture 110, and the engine console 111 located on the upper deck 106.

Figure 9:
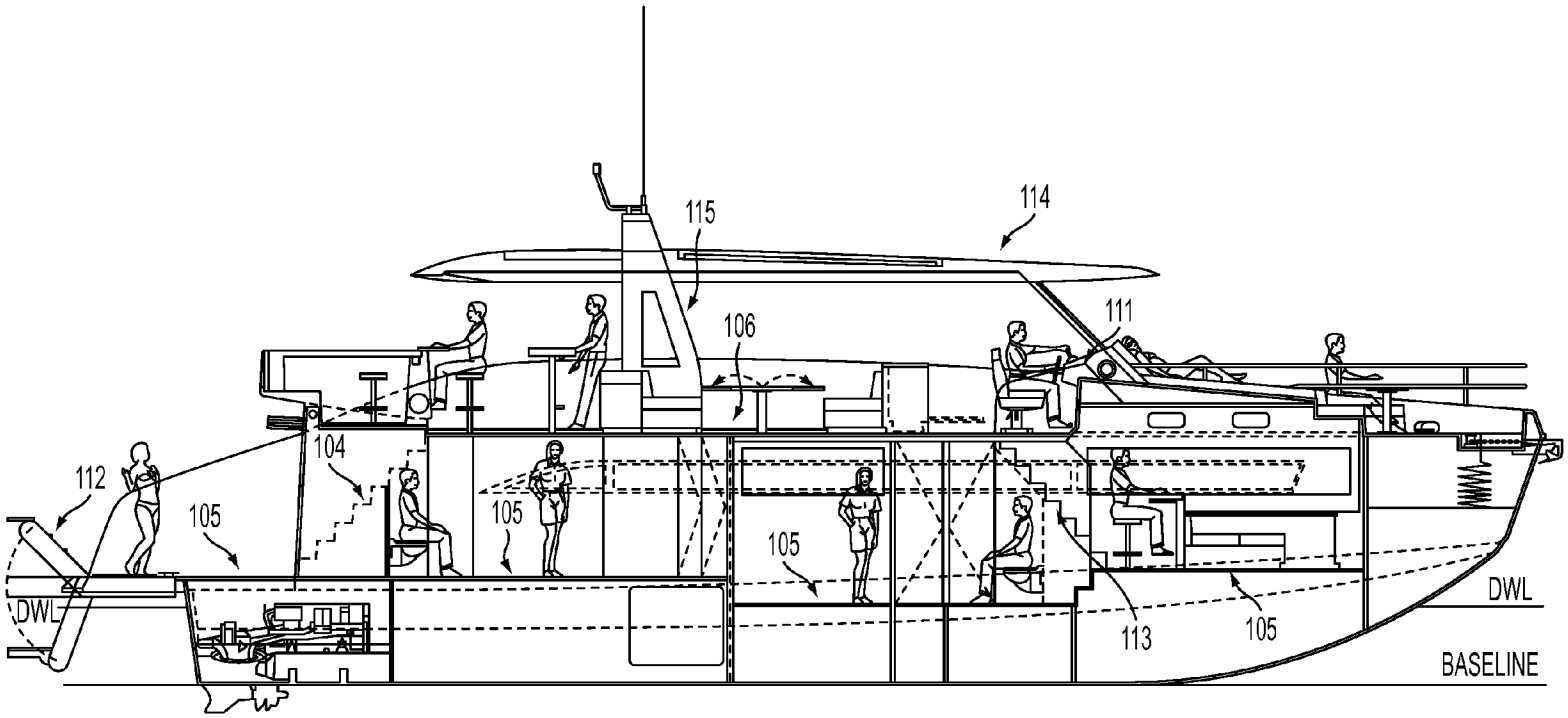
FIG. 9 is a side view section of an embodiment of the water craft of the present invention.

FIG. 9 is a side view section of the same embodiment of the present invention in which it can be more clearly seen that the lower deck. 105 is substantially flat and continuous and extends longitudinally for substantially the entire length of the vessel. This view also illustrates the substantially constant overhead clearance provided by the parallel upper and lower decks 105, 106 in the vessel design of the present invention. Also seen in this view is interior staircase 113 which, in addition to staircase 104 connects the upper deck 106 with the lower deck 105. Finally, shown in FIG. 9 roof structure 114 which is supported by roof supports 115. Roof supports 115 and engine console 111 are the only non-removable obstructions present on upper deck 106.

Figure 10:
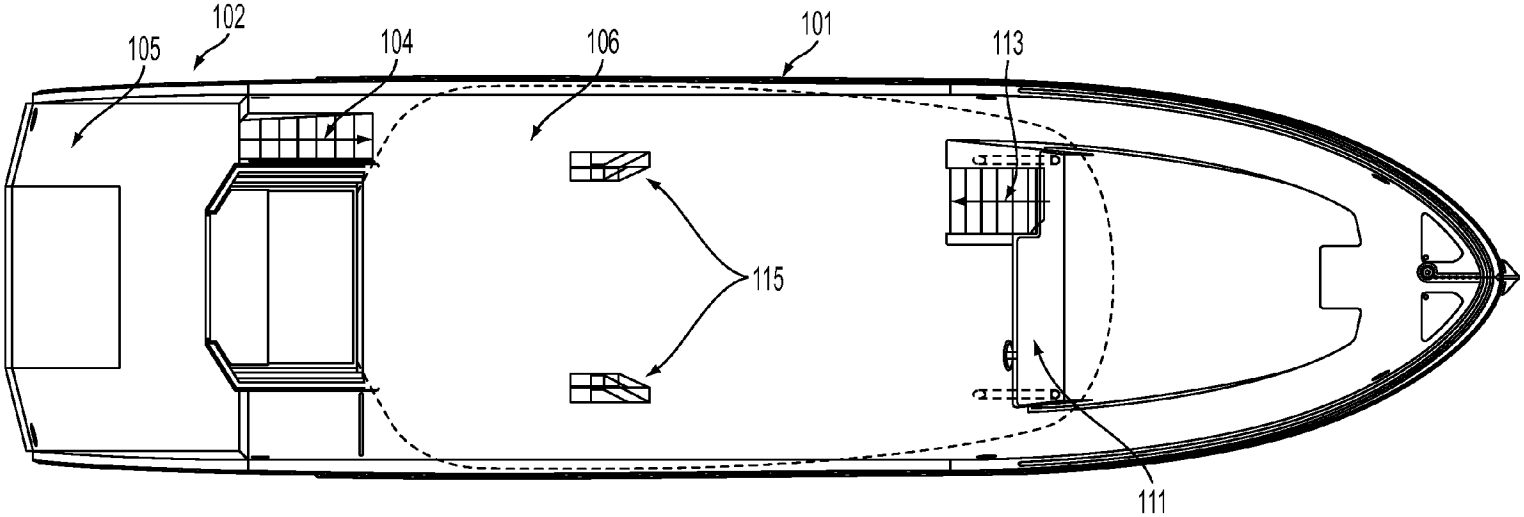
FIG. 10 is a plan view of an embodiment of the water craft of the present invention with the retractable bulwarks retracted.
Figure 11:
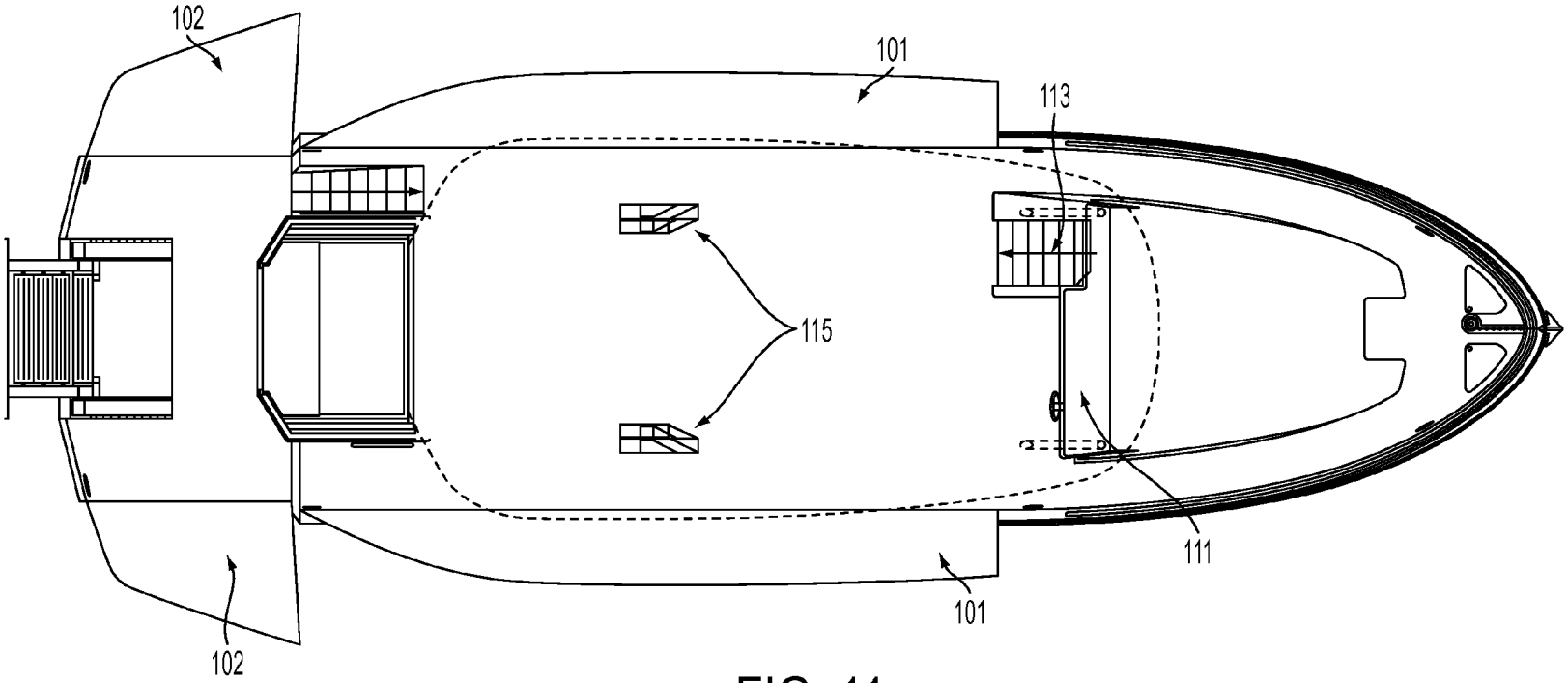
FIG. 11 is a plan view of an embodiment of the water craft of the present invention with the retractable bulwarks extended.

Referring next to FIGS. 10-11, shown is a plan view of the same embodiment of the present invention in which, again, the upper bulwarks 101 and lower bulwarks 102 are shown in retracted (FIG. 10) and extended (FIG. 11) configurations. For clarity of view, roof structure 114 is not shown but roof supports 115 and engine console 111 are visible.

Although the invention is illustrated in detail in the accompanying figures and examples and described herein, various modifications and structural changes may be made therein without departing from the spirit of the invention and within the scope and range &equivalents of the disclosed designs.

We claim:

1. A water craft comprising:

an upper deck including retractable upper bulwarks on one or more sides; and a lower deck having an aft portion and a fore portion, the fore portion located directly below said upper deck, the aft portion extending behind the fore portion and being substantially exposed;

wherein said retractable upper bulwarks, when extended, form a continuous flat surface with said upper deck, said surface being larger in area than said upper deck.

2. The water craft of claim 1 wherein said fore portion of said lower deck is substantially enclosed by side walls except for the rear end thereof in which an opening is defined.

3. The water craft of claim 2 further comprising a door removably covering substantially all of said opening.

4. The water craft of claim 1 further comprising one or more handrails attached to said retractable upper bulwarks.

5. The water craft of claim 4 wherein said one or more handrails are removable.

6. The water craft of claim 4 wherein said one or more handrails are storable.

7. The water craft of claim 1 wherein said upper deck is substantially flat and continuous.

8. The water craft of claim 1 wherein said lower deck is substantially flat and continuous.

9. A water craft comprising:

an upper deck; and a lower deck having an aft portion and a fore portion, the fore portion located directly below said upper deck, the aft portion extending behind the fore portion and being substantially exposed, the aft portion including retractable lower bulwarks on one or more sides;

wherein said retractable lower bulwarks, when extended, form a continuous surface with the aft portion of said lower deck, said surface being larger in area than said aft portion of said lower deck.

10. The water craft of claim 9 wherein said fore portion of said lower deck is substantially enclosed by side walls except for the rear end thereof in which an opening is defined.

11. The water craft of claim 10 further comprising a door removably covering substantially all of said opening.

12. The water craft of claim 9 further comprising one or more handrails attached to said retractable lower bulwarks.

13. The water craft of claim 12 wherein said one or more handrails are removable.

14. The water craft of claim 12 wherein said one or more handrails are storable.

15. The water craft of claim 9 wherein said upper deck is substantially flat and continuous.

16. The water craft of claim 9 wherein said lower deck is substantially flat and continuous.

* * * * *